US006249974B1

(12) United States Patent
Hartzell et al.

(10) Patent No.: US 6,249,974 B1
(45) Date of Patent: Jun. 26, 2001

(54) STRAP REMOVAL DEVICE AND METHOD

(76) Inventors: Bruce Allen Hartzell, 400 Doerrmann Dr., Mickleton, NJ (US) 08056; John Jay Zimmer, 43 Ivy La., Cherry Hill, NJ (US) 08002; Thomas A. Cuthbertson, 24 N. 4th Ave., Poyersford, PA (US) 19468; Edward Pentz, 23 Estate Rd., Boyertown, PA (US) 19512

( * ) Notice: Subject to any disclaimer, the term of this patent is extended or adjusted under 35 U.S.C. 154(b) by 0 days.

(21) Appl. No.: 09/558,668

(22) Filed: Apr. 26, 2000

Related U.S. Application Data

(62) Division of application No. 09/415,860, filed on Oct. 8, 1999.

(51) Int. Cl.[7] ..... B26B 13/26
(52) U.S. Cl. ..... 30/134; 294/104
(58) Field of Search ..... 30/2, 134; 294/19.1, 294/50.8, 104

(56) References Cited

U.S. PATENT DOCUMENTS

| | | | | |
|---|---|---|---|---|
| 289,116 | * | 11/1883 | McDonald | 30/134 |
| D. 321,816 | | 11/1991 | Fushiya et al. | D8/7 |
| D. 361,481 | | 8/1995 | Rees et al. | D8/8 |
| 2,759,758 | * | 8/1956 | Yancey | 294/104 |
| 4,321,952 | | 3/1982 | Natkins | 140/93.2 |
| 4,553,312 | | 11/1985 | Mitzel et al. | 29/564.3 |
| 4,644,646 | * | 2/1987 | Ladin | 30/134 |
| 4,660,818 | | 4/1987 | Conner et al. | 270/1.1 |
| 4,794,671 | | 1/1989 | Goldman | 19/65 R |
| 5,257,457 | | 11/1993 | Cotter | 30/121 |
| 5,325,594 | | 7/1994 | Szafranski | 30/294 |
| 5,669,142 | | 9/1997 | Beckers et al. | 30/314 |

* cited by examiner

*Primary Examiner*—Douglas D. Watts
(74) *Attorney, Agent, or Firm*—Duane, Morris & Heckscher LLP

(57) ABSTRACT

A strap cutting and removing device comprising a pole having a handle end and a gripping and cutting mechanism connected to a gripping actuating means. The device is capable of holding and cutting a strap, wherein the strap remains held as the strap is severed. A method for removing straps is disclosed.

7 Claims, 4 Drawing Sheets

STRAP REMOVAL DEVICE AND METHOD

This application is a divisional of copending U.S. application Ser. No. 09/415,860 filed on Oct. 8, 1999.

BACKGROUND OF THE INVENTION

1. Field of the Invention

The present invention relates to a device and method for removing straps. More particularly, the device and method grip, cut and extract straps binding construction materials within a confined space. Most particularly, the device and method grip, cut and extract straps binding expandable materials loaded on trucks.

2. Brief Description of the Related Art

Straps are known for binding materials in bales for transport ease and efficiency.

These materials may include rags, insulation, working tools, paper, and various other materials. During transport, the bound materials are placed on platforms, trucks, ledges, and other such locations, where the bundles are un-strapped. Many times, the location of the strapped bale is at a distance or different level than the worker who needs to un-strap the bundle.

Typical devices for strap removal generally consist of a cutting tool, such as knife or other sharp edge attached to a handle. The cutting tool may have a two inch long blade with an adjacent five inch long handle. Workers must position themselves alongside the insulation bales to cut the straps. Climbing onto a high platform next to heavy bales may be awkward, and workers are exposed to hazards such as falling and crushing dangers. Workers standing alongside the bundles are subject to the hazards of snapping straps or expanding materials when the straps are cut. Once the straps are cut, removal of the straps may be time consuming, and at times, impossible. Cut straps tend to snap into the baled materials, and become obscured within those materials. Within a confined space, workers are restricted in their ability to position themselves to search for the cut straps. Hard to locate cut straps decrease worker efficiency.

Other types of cutting devices have been developed, but have limited applicability in cutting and removing straps. Such devices include U.S. design patent 361,481 (Rees et al.), entitled Tree Limb Trimmer and U.S. design patent 321,816, entitled Tree Pruner. U.S. Pat. No. 5,257,457 (Cotter), entitled Hand-Held Tree Girdler, discloses a L-shaped tool with an attached cutting blade. However, these patents are not directed to cutting straps off bales, and do not disclose any method for removing the straps, once cut.

U.S. Pat. No. 4,794,671 (Goldman), entitled Method for Opening Bales of Cotton and Other Fibers, discloses rollers that pull straps off bales, and U.S. Pat. No. 4,660,818 (Conner et al.), entitled Unstrapping Apparatus, discloses a hook assembly for unstrapping bands from bales. U.S. Pat. No. 4,553,312 (Mitzel et al.), entitled Device for Removing a Band from a Sheet Bundle, discloses a cut band which is run into a hook. These patents require extensive machinery for the movement of the bales for cutting the bale straps, and separate mechanisms for cutting and capturing the strap for removal.

Patents disclosing hand tools for cutting straps and insulation batts are known. U.S. Pat. No. 5,325,594 (Szafranski) and U.S. Pat. No. 5,669,142 (Beckers et al.) disclose hand tools for cutting batts. U.S. Pat. No. 4,321,952 (Natkins) discloses a strap tightening hand tool that has a knife.

However, these patents do not disclose unstrapping bales at a distance, or engaging the cut strap for removal.

There is a need in the art to provide a strap removal device and method for removing straps from bound materials.

SUMMARY OF THE INVENTION

The present invention provides a strap cutting and removing device comprising a pole having a handle end and a capture end; a gripping and cutting mechanism secured to the capture end capable of holding and cutting a strap, wherein the strap remains held as the strap is severed; and, gripping actuating means for closing the gripping and cutting mechanism.

The present invention further provides a method for removing straps comprising providing a strap cutting and removing device comprising a pole having a handle end and a capture end, a gripping and cutting mechanism secured to the capture end capable of holding and cutting a strap, wherein the strap remains held as the strap is severed, and, gripping actuating means for closing the gripping and cutting mechanism; gripping the strap with the gripping mechanism; severing the gripped strap with the cutting mechanism, wherein the strap remains gripped; and, extracting the gripped, cut strap.

DETAILED DESCRIPTION OF THE PREFERRED EMBODIMENT

The present invention is a strap cutting and removing device and method for removing straps. The device grips, severs and extracts straps from baled materials.

In the preferred embodiment, the device and method of the present invention are used in conjunction with the operation of a the system disclosed in U.S. patent application Ser. No. 885,521, filed Jun. 30, 1997, herein incorporated by reference. Insulation materials, which are typically bound into bales by straps to prevent expansion of the insulation, are loaded on a truck. Once loaded, the strap cutting and removing device captures the strap by gripping and then severing the strap. The device then extracts the strap by drawing the individual straps from around the bales, and out of the truck. After the straps are removed from the bales, the insulation within the truck is fed to a dispersing mechanism which conveys the materials out of the truck.

Five straps generally longitudinally wrap the bales of various weights which are expandable only along a single longitudinal axis or direction. Vertical strapping of the bales is not required. Typically, the straps are made of elastic or other suitable binding materials, such as plastics, nylon, and/or other like stretchable materials, fabrics, thin metals and the like. Straps vary in width, but generally reach from about one-quarter inch to about one inch in width, more typically measuring from about one-half inch to about five-eights inch in width. The straps have a length which is sufficient to extend around the bales, generally placing the straps in a stretched condition while binding the material. The straps have elastic properties which cause a stretched strap to snap or retract when cut. Ungripped straps retract into and become obscured by the material that is baled. Once a strap has retracted into the bales, locating the retracted strap for future removal becomes problematical. Any straps which are not removed from the truck prior to the dispersing of the baled material may foul the dispersing mechanism.

Figure 1:
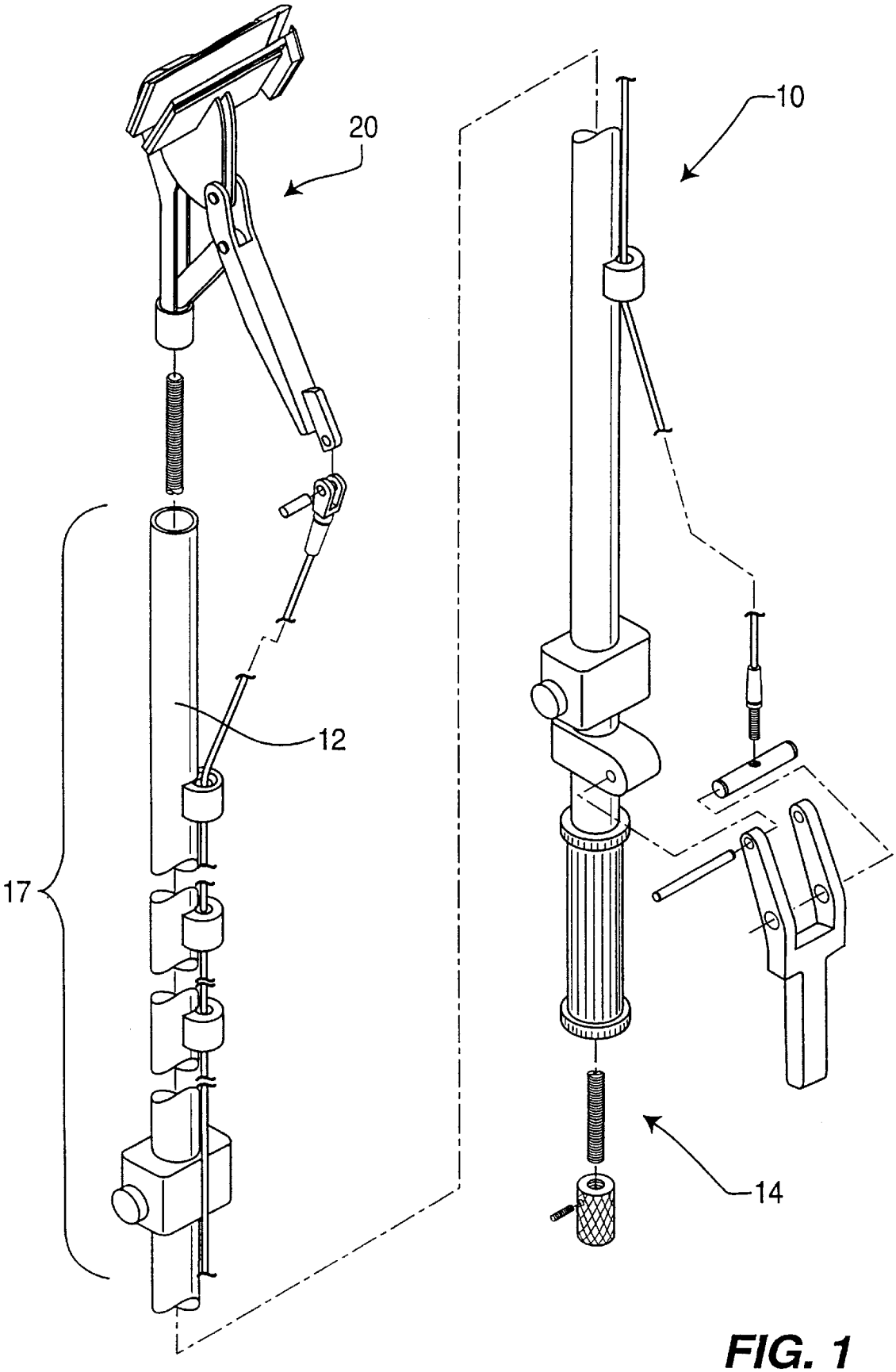
FIG. 1 is a side elevational view of the preferred embodiment of the strap cutting and removing device of the present invention.

As seen in FIG. 1, the strap cutting and removing device 10 comprises an extender or pole 12 having a handle end 14 and a capture end 20. The pole 12 has a length 17 between the handle end 14 and a capture end 20 which enables an operator to extend the pole 12 and reach a distant point with the capture end 20 while holding the handle end 14. The pole may have any length 17 which permits the extension of the capture end 20 to grip a strap. Preferably the pole 12 is from about two feet or greater in length, more preferably the pole 12 is from about four feet to about nine feet in length, and most preferably the pole 12 is from about six feet to about eight feet in length.

The pole 12 is held by an operator holding the handle end 14 while extending the pole 12. The handle end 14 may include, but not limited to, handles, tape, grips, stripping, latex coatings, enamel coatings and/or the like. The handle end 14 may be contoured or padded, and have a diameter which permits convenient grasping and easy holding of the pole 12 by hand, when extended. The handle end 14 may comprise a designated area with no padding or other type of variation or distinguishing characteristic. Additional holding areas may also be placed along the length of the pole 12 for convenience of an operator to lift, hold, extend and/or position the pole 12 during a strap cutting and removing operation, movement or other function of the device 10.

Figure 2:
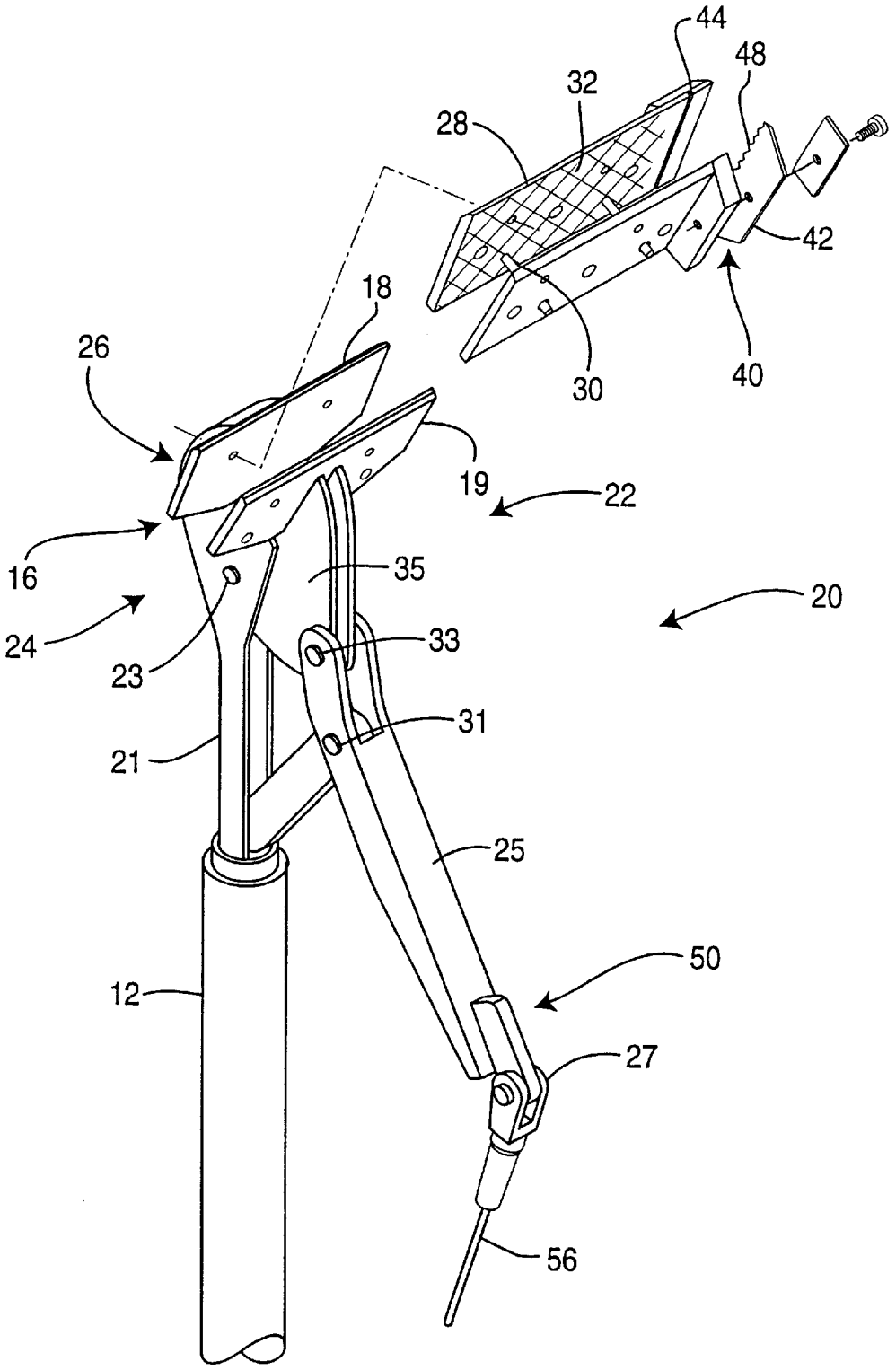
FIG. 2 is a side elevational view of the capture end of the device.

As seen in FIG. 2, a gripping and cutting mechanism 22 is secured to the capture end 20 of the pole 12. The mechanism 22 comprises a gripper 24 which is capable of gripping, or holding, onto a strap. The gripper 24 comprises any mechanism capable of firmly grasping, and securing or locking, a strap to the device 10 prior to and after the strap is severed. The gripper 24 may include hook structures such as hooks, locks, anchor devices, and like configurations, and/or clamp structures such as clamps, grips, vices, screws, and other like implements which permit an operator to engage and maintain possession or control of a strap with the device 10. Preferably, the gripper 24 comprises a plier grip 26.

In the preferred embodiment, the plier grip 26 comprises jaws 16 having two sectioned plates 18 and 19 that close against each other. The pole 12 has a neck extension 21 which forms a lip section onto which sectioned plate 18 is attached. Sectioned plate 19 is pivotally mounted to the pole 12 by means of a bolt 23 connected through the neck extension 21. The plier grip 26 is moved by a gripper actuating means 50 which comprises a control arm 25. The front end of the control arm 25 is fixed to the back of plate 19, and movement of control arm 25 about a pin 31 raises the front end of the control arm 25. A second pin 33 attaching the front end of the control arm 25 to a neck piece 35 is raised as the front end of the control arm 25 raises during a pivot motion about pin 31. The neck piece 35 is forced down with a pivoted motion about pin 23 which forces sectioned plate 19 against sectioned plate 18, permitting the two plates to close together. At the back end to the control arm 25, a pin 27 connects a cord 56 to the control arm 25. The cord 56 extends from the capture end 20 along the length of the pole 12 towards the handle end 14.

The plates 18 and 19 have a rectangular shape forming a surface friction area 28. The surface friction area 28 is preferably from about one-half inch to about four inches in width, more preferably from about one inch to about three inches in width, and most preferably from about two inches to about three inches in width. Preferably the length of the surface friction area 28 extends from about three inches to about ten inches, more preferably from about four inches to about eight inches, and most preferably from about five inches to about six inches. The surface friction area 28 length is measured relative to the perpendicular direction to the pole length 17, with the width of the surface friction area 28 measured perpendicular to the direction of the surface friction area 28 length.

The gripper 24 further has teeth 30 located on the surface friction area 28 which are capable of piercing a strap. As a further gripping component, the surface friction area 28 may comprise serrations 32 which engage the strap with sufficient friction to apply a significant pulling force on the strap. A significant pulling force includes sufficient force to remove a parted strap from around the contained material. When a hook structure is used, a strap may have holes located along the length of the strap. This allows the hook structure to attach to the strap through one or more of the holes, and maintain attachment with the strap even after the strap is severed.

The mechanism 22 also comprises a cutter 40 fixed to the capture end 20 of the pole 12. The cutter 40 is located along side of the gripper 24 in such a way as to permit a vertical cut on a strap which is being held by the gripper 24. The cutter 40 may be joined directly to the gripper 24, or may be mounted to the pole 12 in a fixed position relative to the gripper 24. The cutter 40 is any device which is capable of severing, cutting or otherwise parting a strap which is gripped by the mechanism 22. This includes, but is not limited to, razor edges, flat blades, curved blades, rotary blades, knifes, saws, shears, scissors, files, burning or heating elements and wires, and other such severing mechanisms determinable by those skilled in the art. The cutter 40 may further be either hand-operated or motor powered by such means as air-driven, electric, combustion, or other motor-type means determinable by those skilled in the art. Preferably, the cutter 40 is affixed laterally adjacent to and longitudinally alongside of the gripper 24, which permits a perpendicular cut across the width of the strap as the strap is held horizontally in the gripper 24. The cutter 40 preferably comprises a singular blade 42, and more preferably the blade 42 has serrations 48. The cutter 40 may further form a recess 44 for receiving the blade 42 when the cutter 40 has been closed against the strap. The length of the blade 42 may be any length which facilitates the cutting of the strap. Preferably the blade 42 comprises a length of from about one inch to about eight inches, more preferably a length of from about one inch to about six inches, and most preferably a length of from about one inch to about four inches.

Figure 3A:
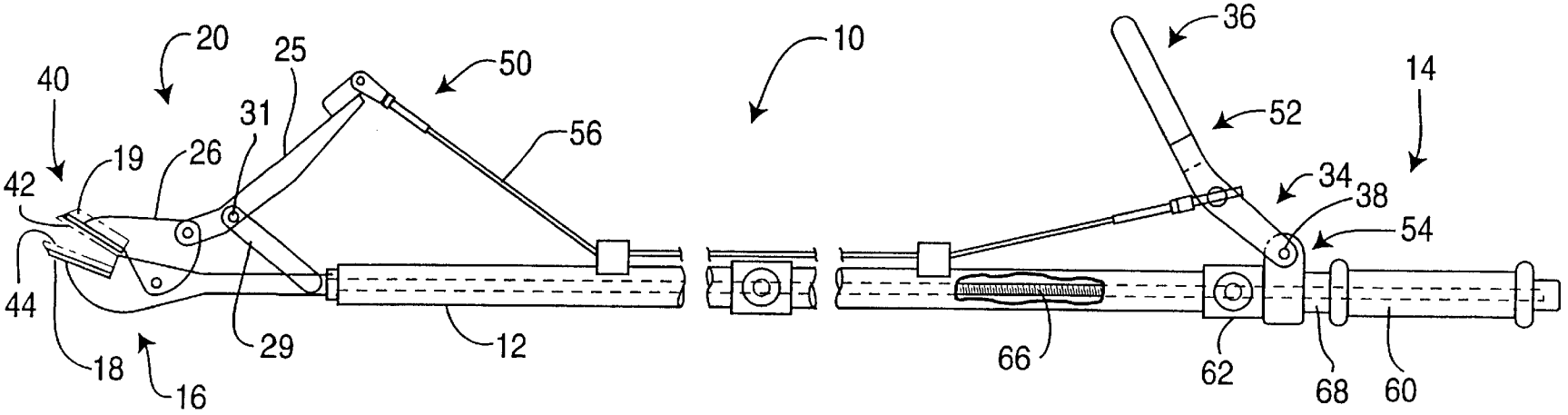
FIGS. 3A–3B are side views showing an open and closed position of the device; and, FIG. 4 illustrates the operation of the strap cutting and removing device showing the device extracting a gripped and severed strap.
Figure 3B:
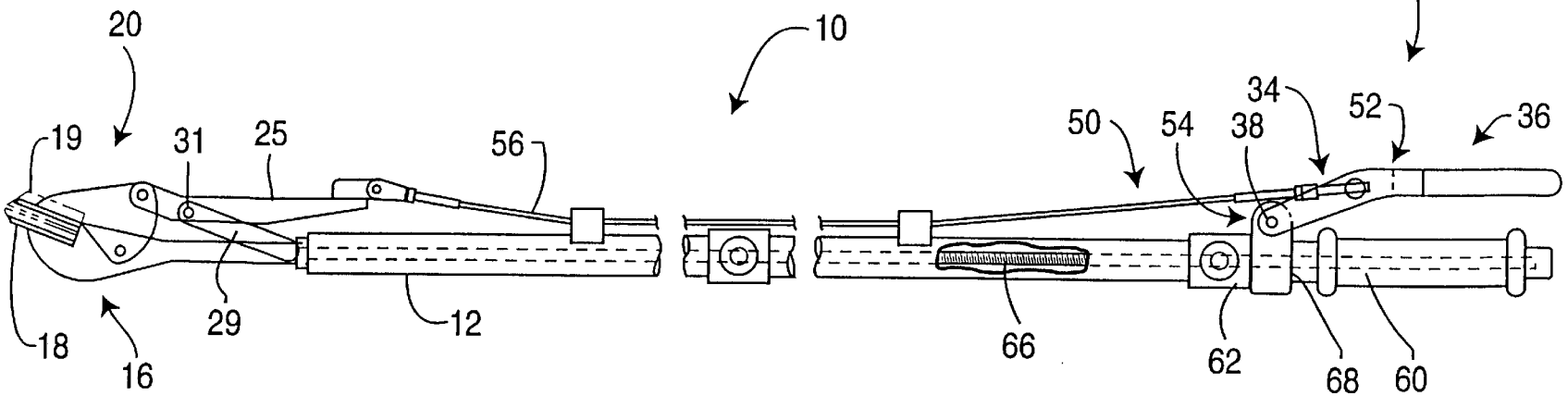

As seen in FIGS. 3A–3B, the device 10 further comprises a gripping actuating means 50 which permits an operator to remotely operate the closing of the jaws 16 while the operator remains positioned at the handle end 14 of the pole 12. The gripping actuating means 50 includes, but is not limited to, lever arms, pull cords, rotary pole sections, pressure latches, and the like. Preferably, the gripping actuating means 50 comprises a lever arm 52. The preferred lever arm 52 configuration is pivotally attached to the pole 12 at a fulcrum point 54 connected by such means as an adjusting knob 38 comprising a medium diamond knurl or the like. The adjusting knob 38 provides a fulcrum point 54 proximate to the handle end 14, either attached directly to the pole 12, or attached by a bracket on the pole 12. The lever arm 52 preferably comprises an elbow-shaped structure, forming a first arm 34 and second arm 36. The lever arm 52 comprises sufficient size to be hand-activated with a single pull motion on the lever arm 52, while an operator holds the handle end 14 of the pole 12 with another hand. The cord 56 is attached to the elbow of the lever arm 52 between the first arm 34 and second arm 36, with the cord 56 extending from the lever arm 52 to the control arm 25. The cord 56 may be any material which is capable of transferring a pulling force from the lever arm 52 to the control arm 25. Preferably, the cord 56 comprises a metal wire, nylon or fabric rope, and the like.

As the operator holds the handle end 14 of the pole 12 with one hand, the operator extends the capture end 20 adjacent to a strap which is binding the material. When the strap is located within the jaws 16 of the mechanism 22, the operator grips and pulls back on the second arm 36 of the lever arm 52, which rotates the first arm 34 away from the capture end 20. A pulling force is transferred from the lever arm 52, through the cord 56, causing the jaws 16 of the mechanism 22 to close and grip the strap. As the jaws 16 close onto the strap, the cutter 40 which is positioned across the strap, engages and cuts the strap.

A cutting actuating means 60 permits cutter 40 to further secure to and lock onto a strap after the gripping actuating means 50 has been activated. Once the plates 18 and 19 are pressed together on a strap with the strap becomes located between the blade 42 and recess 44, the cutting actuating means 60 may then be used to ensure the strap is severed. Additionally, the cutting actuating means 60 may reposition and/or sever the strap. The cutting actuating means 60 may comprise draw strings, pull cords, screw gears, and/or other such activating devices determinable by those skilled in the art. Preferably, the cutting actuating means 60 comprises a screw gear 62 which is rotationally engaged by turning the cutting actuating means 60 and the pole 12 against each other. More preferably, the screw gear 62 is located internally within a channel formed inside of the pole 12. Gears or screw teeth 68 within the screw gear impel or extend a rod 66, which is located internally through the channel in the pole 12 and connected to the pivot arm 29, when the cutting actuating means 60 is turned relative to the pole 12 to engage the gears. The interconnecting screw teeth 68 slide or ratchet with the pole 12 and cutting actuating means 60 rotation, which advances the rod 66 in the direction of the pivot arm 29. The advancing rod 66 forces the pivot arm 29 upward, which forces the control arm 25, through pin 31, forward. Longitudinal movement of the pivot arm 29 forces incremental movement of the control arm 25 adding to the force of the plates 18 and 19 pressing against each other. After the sectioned plates 18 and 19 are forced together from the control arm 25, upward movement of the pivot arm 29 further tightens the jaws 16 together. This forces the cutter 40 to further close down onto a gripped strap. As the blade 42 is forced onto the strap, the strap is cut. The cutting actuating means 60 may further comprise a locking mechanism for the cutting actuating means 60 may be used to ensure constant tightness of the closed jaws 16. The locking mechanism is any component which allows the operator to hold the movement of the control arm 25 from the cutting actuating means 60 to remain forward. The design and construction of the locking component being determinable by those skilled in the art.

The strap may be severed at any time once the strap is gripped by the closing motion of the jaws 16, by engaging the cutting actuating means 60, and/or by a twisting and yanking movement of the pole 12, when necessary. As the capture end 20 is closed by engaging the gripping actuating means 50, a strap may be cut as the blade 42 enters into the recess 44 and is forced against the strap. In situations where the strap is not cut when the jaws 16 are closed, the screw gear 62 is rotated to extend the rod 66 to further force the blade 42 into the recess 44, which further promotes cutting the strap. If the strap is still not cut after the pole sections 64 are rotated, the operator may twist and/or yank the device 10 to completely part the partially cut strap.

Figure 4:
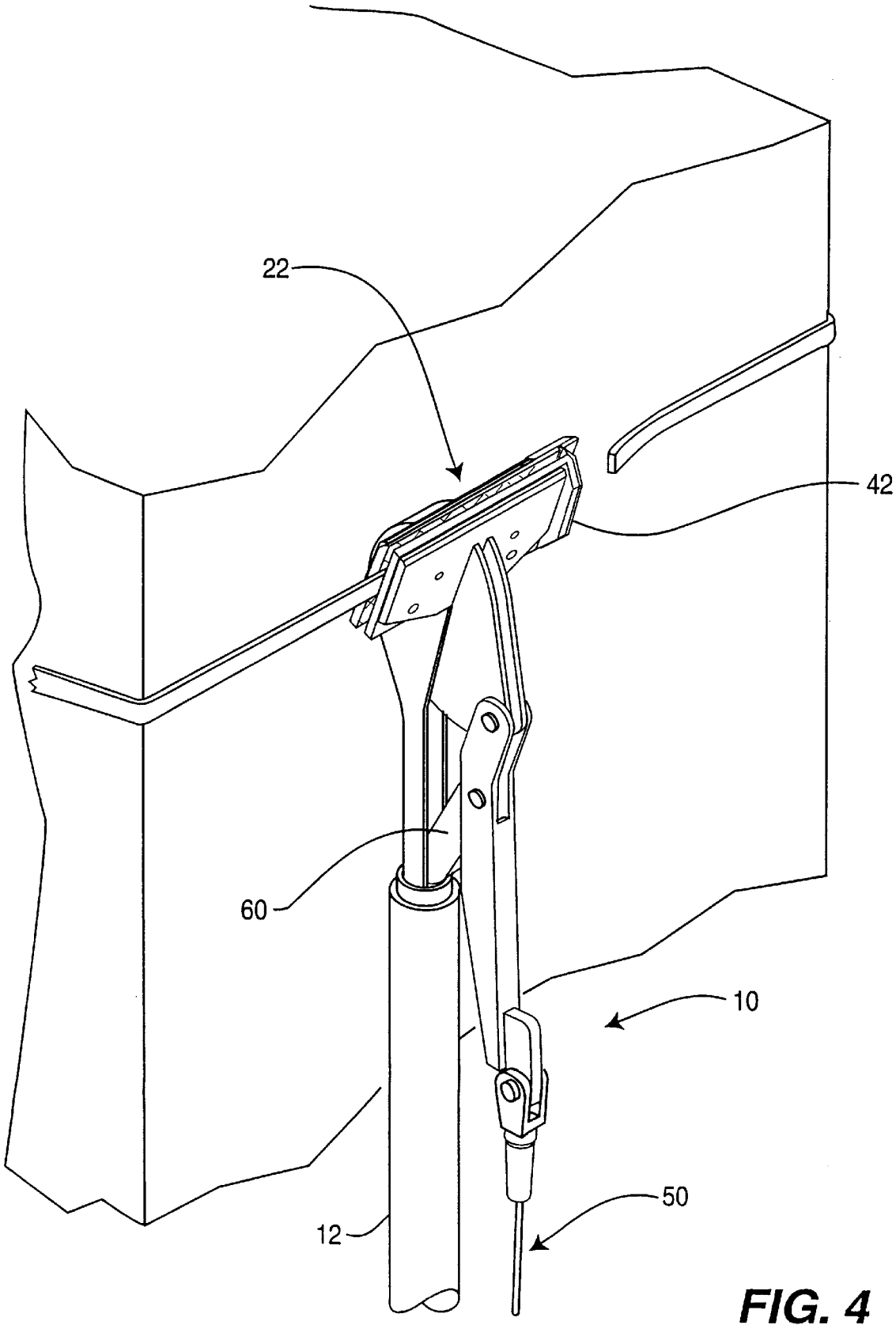

FIG. 4 shows the strap severing and removing device 10 gripping, cutting and extracting a strap. In operation, the strap cutting and removing device 10 provides an efficient method for removing straps. Straps are removed by providing the strap cutting and removing device 10 to an operator. The operator holds the device 10 and extends the pole 12 to position the gripping and cutting mechanism 22 adjacent to the strap. The operator grips the strap with the mechanism 22 by pulling on a lever arm 52, which closes the plates 18 and 19 onto the strap with the teeth 30 piercing the strap. The operator further engages the cutting actuating means 60, which forces the blade 42 against the strap, after which the blade 42 is locked in place. Once the blade 42 is locked, the operator pulls back on the pole 12 while holding onto the handle end 14. The cut strap remains gripped in the device 10 while being extracted. Once removed, the strap is released from the device 10 and discarded.

Example

Bales of horizontally expandable material are loaded onto a truck with the straps exposed. A strap cutting and removing device is provided comprising a seven foot pole having a handle end at one end and a plier grip having teeth and serrations attached to another end, which is connected by a pull cord to a lever arm proximate to the handle end. The strap cutting and removing device also has a single blade attached to the clamp structure which is connected to a screw gear inside the pole. In one hand, an operator holds on to the handle end of the strap cutting and removing device and extends the plier grip to a position adjacent to one of the straps on a bale. The operator actuates the plier grip by pulling on the lever arm with another hand, which closes the teeth and serrations of the plier grip onto the adjacent strap, attaching the strap to the strap cutting and removing device. Once the strap is attached to the strap cutting and removing device, the operator actuates the blade by rotating the handle relative to the pole. This engages the screw gear and the blade cuts the strap, without detaching the strap from the plier grip. The operator then extracts the severed strap by pulling on the strap cutting and removing device, which draws the strap in the direction of the operator. After the strap is extracted, the operator opens the plier grip and detaches the strap from the strap cutting and removing device. The operator then extends the strap cutting and removing device to a position adjacent to another strap which is binding the baled material. This process is repeated until all visible straps are extracted.

The foregoing summary, description, drawings, and example of the invention are not intended to be limiting, but are only exemplary of the inventive features which are defined in the claims.

What is claimed is:

1. A strap cutting and removing device comprising:

a pole having a handle end and a capture end;

a gripping and cutting mechanism secured to the capture end capable of holding and cutting a strap, wherein the strap remains held as the strap is severed; and gripping actuating means for closing the gripping and cutting mechanism, wherein the gripping and cutting mechanism comprises a plier grip including teeth.

2. The device of claim 1, wherein the gripping actuating means comprises a lever arm attached to the pole and connected to the gripping and cutting mechanism by a cord.

3. The device of claim 1, wherein the mechanism comprises a blade, and wherein the plier grip comprises a first plate and a second plate pivotally connected to form a gripping area, the first plate fixed to the pole, and the second plate having the blade fixed thereon within the gripping area, wherein rotation of the second plate in relation to the first plate forces the blade against the first plate.

4. The device of claim 3, wherein the blade comprises serrations.

5. The device of claim 3, further comprising a cutting actuating means for further forcing the blade against the first plate.

6. The device of claim 5, wherein the cutting actuating means comprises a screw gear located internally within the pole.

7. The device of claim 6, wherein the cutting actuating means further comprises a rod which is capable of being impelled by the screw gear.

* * * * *